US011041673B2

(12) United States Patent
Kwon et al.

(10) Patent No.: US 11,041,673 B2
(45) **Date of Patent: *Jun. 22, 2021**

(54) REFRIGERATOR

(71) Applicant: LG Electronics Inc., Seoul (KR)

(72) Inventors: Hyokku Kwon, Seoul (KR); Seonil Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/863,769

(22) Filed: Apr. 30, 2020

(65) Prior Publication Data

US 2020/0256615 A1 Aug. 13, 2020

Related U.S. Application Data

(63) Continuation of application No. 16/093,861, filed as application No. PCT/KR2017/004074 on Apr. 14, 2017, now Pat. No. 10,677,518.

(30) Foreign Application Priority Data

Apr. 15, 2016 (KR) ..... 10-2016-0046050

(51) Int. Cl.
*F25D 25/00* (2006.01)
*F25D 25/02* (2006.01)
(Continued)

(52) U.S. Cl.
CPC ..... *F25D 25/024* (2013.01); *A47B 96/02* (2013.01); *F25D 23/02* (2013.01); *F25D 23/06* (2013.01);
(Continued)

(58) Field of Classification Search
CPC ..... A47B 96/02; F25D 25/024; F25D 25/00; F25D 25/02; F25D 25/025; F25D 23/02;
(Continued)

(56) References Cited

U.S. PATENT DOCUMENTS 1,835,847 A * 12/1931 Chandler ..... F25D 25/02 62/265
2,095,811 A * 10/1937 Goulooze ..... F25D 25/024 312/274
(Continued)

FOREIGN PATENT DOCUMENTS

EP 2218992 * 8/2010
JP H08308659 * 11/1996
(Continued)

OTHER PUBLICATIONS

Ntemational Search Report in International Application No. PCT/KR2017/004074, dated Jul. 21, 2017,4 pages (Year: 2017).*
(Continued)

*Primary Examiner* — Janet M Wilkens
(74) *Attorney, Agent, or Firm* — Fish & Richardson P.C.

(57) ABSTRACT

A refrigerator according to an embodiment of the present disclosure comprises: a cabinet; a door; a shelf supporting arm; a shelf assembly; and a withdrawing mechanism for allowing a shelf to be withdrawn forward when the door is pivoted, wherein the withdrawing mechanism includes a sliding member, a link member, and a connector for selectively connecting the slide member and the shelf. The connector includes: a connecting unit selectively inserted into a receiving groove formed in the sliding member and having a first inclined face formed on one side thereof; and an actuation unit having a second inclined face formed on one end thereof to contact the first inclined face, wherein when the actuation unit moves toward the rear side of the cabinet, the second inclined face moves along the first inclined face so that the connecting unit moves to be separated from the groove.

19 Claims, 17 Drawing Sheets

(51) Int. Cl.
*A47B 96/02* (2006.01)
*F25D 23/02* (2006.01)
*F25D 23/06* (2006.01)

(52) U.S. Cl.
CPC ..... *F25D 23/065* (2013.01); *F25D 23/069* (2013.01); *F25D 25/00* (2013.01); *F25D 25/02* (2013.01); *F25D 2201/10* (2013.01)

(58) Field of Classification Search
CPC ..... F25D 23/06; F25D 23/065; F25D 23/069; F25D 23/028; F25D 23/062; F25D 2201/10; F25D 2323/024
USPC ..... 312/408, 405.1, 405
See application file for complete search history.

(56) References Cited

U.S. PATENT DOCUMENTS 5,810,462 A * 9/1998 Lee ..... F25D 25/027 312/405.1
9,726,423 B1 * 8/2017 Swarnkar ..... F25D 23/028
10,203,152 B2 * 2/2019 Yang ..... A47B 96/16
2013/0257255 A1 * 10/2013 Hwang ..... F25D 23/02 312/404
2015/0123532 A1 * 5/2015 Kwon ..... F25D 23/025 312/404
2016/0187052 A1 * 6/2016 Park ..... F25D 25/024 312/408
2017/0227280 A1 * 8/2017 Yang ..... A47B 88/41
2017/0314846 A1 * 11/2017 Yu ..... A47B 88/417
2017/0350642 A1 * 12/2017 Yang ..... F25D 23/028
2018/0038632 A1 * 2/2018 Yang ..... F25D 25/025
2018/0274841 A1 * 9/2018 Cizik ..... F25D 25/025
2019/0242641 A1 * 8/2019 Yang ..... F25D 23/028

FOREIGN PATENT DOCUMENTS

KR 1020040059041 * 7/2004
KR 100760403 * 9/2007
KR 1020100130357 * 12/2010
KR 2020110006604 * 6/2011
WO 2016129947 * 8/2016
WO 2017179950 * 10/2017

OTHER PUBLICATIONS

EP Supplementary Search Report in European Application No. EP 17782705, dated Oct. 24, 2019, 5 pages (Year: 2019).*

* cited by examiner

REFRIGERATOR

CROSS-REFERENCE TO RELATED APPLICATIONS

This application is a continuation of U.S. application Ser. No. 16/093,861, filed on Oct. 15, 2018, which is National Stage application under 35 U.S.C. § 371 of International Application No. PCT/KR2017/004074, filed on Apr. 14, 2017, which claims the benefit of Korean Application No. 10-2016-0046050, filed on Apr. 15, 2016. The disclosures of the prior applications are incorporated by reference in their entirety.

TECHNICAL FIELD

The present disclosure relates to a refrigerator.

BACKGROUND

A refrigerator is a household appliance used to store food in a refrigerated or frozen state.

In recent years, the capacity of the refrigerator has been increasing. A home bar, ice maker, shelf or door box has been mounted on the back face of the refrigerator door. A refrigerator is a household appliance used for storing food in a refrigerated or frozen state.

In this type of refrigerator, when the refrigerator door is closed, a shelf or storage box mounted on a storage compartment of the refrigerator main body may interfere with components mounted on the back face of the refrigerator door.

In order to solve this interference problem, a front end of the shelf or storage box mounted inside the storage room of the refrigerator main body, that is, a refrigerator compartment or a freezer compartment, is disposed at a position spaced from the front face of the refrigerator main body by a predetermined distance. Therefore, in order to retrieve the food stored in the shelf or storage box, the user may have inconvenience to insert his/her hand deeply into the storage room.

Further, it is difficult for the user to confirm the food stored in the rear position of the storage room. This problem is more pronounced in large refrigerators. That is, in the casing of the large refrigerator, an anteroposterior dimension of a refrigerator compartment or a freezer compartment is large. Thus, this has the disadvantage that the user cannot easily pull out the food stored deeply in the rear-end portion of the shelf.

To remove this disadvantage, Korean Patent Publication No. 2010-0130357 discloses a refrigerator in which a shelf or a storage box installed in a refrigerator compartment or a freezer compartment is placed on an L-shaped storage frame, and the storage frame is connected to a bottom of the refrigerator door via a multi-joint link.

However, the refrigerator presented in the prior art document has following problems.

First, regardless of the intention of the user, the shelf and the storage box are always drawn out in a front direction of the refrigerator in conjunction with the opening of the refrigerator door. Thus, there is an inconvenience that the shelf and storage box cannot be used in a fixed position.

Second, the frame structure for drawing out the shelf is exposed to the outside. Thus, there is a problem that when the refrigerator door is opened, the inside of the refrigerator cannot be visible clearly, and it is difficult to clean the inside of the refrigerator.

Technical Purpose

The present disclosure is proposed to improve the problems of the prior art as presented in the above. The purpose of the present disclosure is to provide a refrigerator in which coupling between a shelf and a withdrawing mechanism for withdrawing the shelf may be released by a simple operation.

Technical Solution

In one aspect of the present disclosure, there is provided a refrigerator comprising: a cabinet having a storage space defined therein; a door pivotally connected to a front face of the cabinet for selectively opening and closing the storage space; a shelf assembly including a shelf support arm fixed to an inner side of the cabinet, and a shelf slidably connected to the shelf support arm; and a withdrawing mechanism configured for allowing the shelf to be withdrawn forward when the door is pivoted to open the storage space.

The withdrawing mechanism includes: a sliding member installed on a side face of the cabinet so as to move in anteroposterior direction; a link member having a front-end portion connected to the door and a rear-end portion thereof connected to the sliding member, wherein the link member is configured for allowing the sliding member to move forward or rearward together with the pivoting movement of the door; and a connector for selectively connecting the sliding member to the shelf.

The connector includes: a connecting unit selectively inserted into a receiving groove formed in the sliding member, wherein the connecting unit has a first inclined face formed on one side thereof; and an actuating unit having a second inclined face formed on one end thereof, wherein the second inclined face contacts the first inclined face, wherein when the actuating unit moves toward a rear face of the cabinet, the second inclined face moves along the first inclined face such that the connecting unit moves to be separated from the receiving groove.

Technical Effects

The refrigerator according to embodiments of the present disclosure has following effects.

First, the coupling between the shelf and the withdrawing mechanism for withdrawing the shelf may be released by a simple operation using a pressing button. Thus, there is an advantage that the user may freely choose whether or not to use the shelf automatic withdrawing function in response to the opening of the refrigerator door.

Second, the button structure for releasing the coupling between the shelf and the withdrawing mechanism does not interfere with the components installed in the refrigerator. Thus, there is an advantage that interference does not occur when using refrigerator.

Third, since the button structure for releasing the coupling between the shelf and the withdrawing mechanism is simplified and detachable, the material cost may be reduced and the refrigerator may be easily maintained.

DETAILED DESCRIPTIONS

Hereinafter, a refrigerator according to an embodiment of the present disclosure will be specifically described with reference to the drawings.

Figure 1:
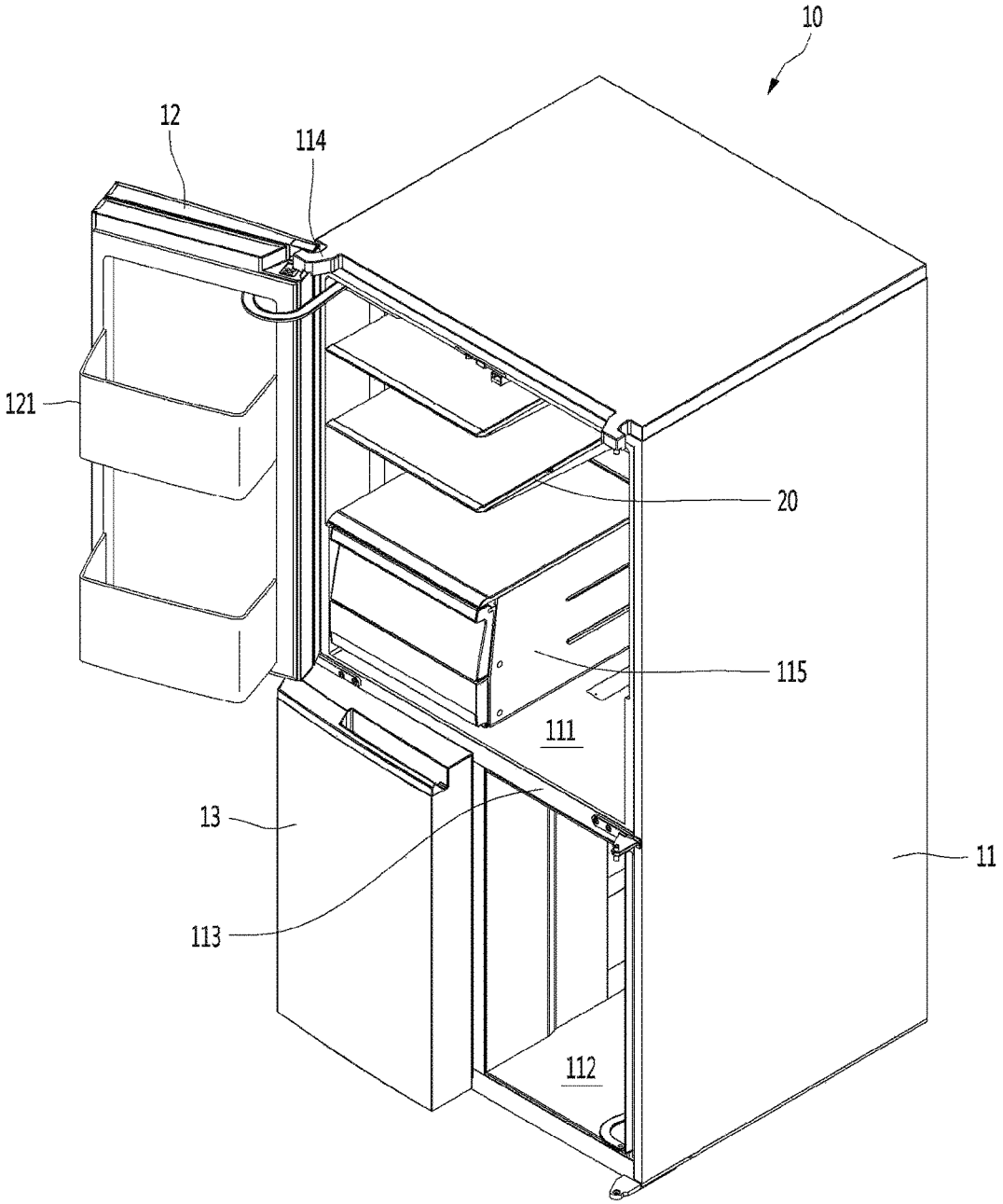
FIG. 1 is a perspective view of a refrigerator according to an embodiment of the present disclosure.
Figure 2:
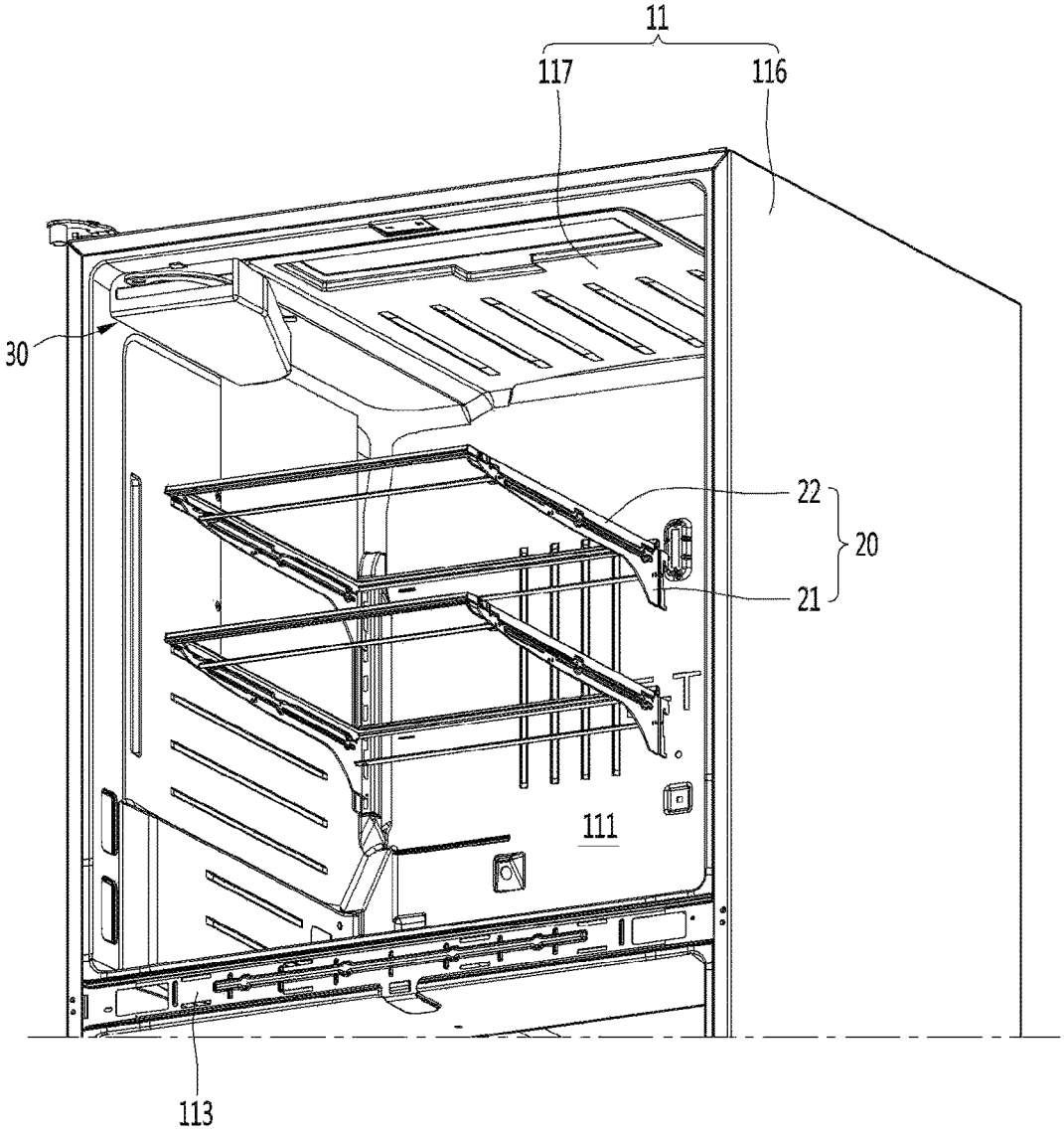
FIG. 2 is a perspective view showing an interior of the refrigerator according to an embodiment of the present disclosure.

FIG. 1 is a perspective view of a refrigerator according to an embodiment of the present disclosure. FIG. 2 is a perspective view of a refrigerator according to an embodiment of the present disclosure.

Referring to FIG. 1 and FIG. 2, The refrigerator 10, according to the embodiment of the present disclosure may include a cabinet 11 having a storage space formed therein, and a door that is pivotally or slidably mounted on the front face of the cabinet 11 to selectively open and close the storage space.

Specifically, the storage space may include a refrigerator compartment 111 provided to store food in a refrigerated state, and a freezer compartment 112 provided to store the food in a frozen state. In addition, the refrigerator compartment 111 may be disposed above, below or to the side of the freezer compartment 112. In this embodiment, the refrigerator compartment 111 is partitioned from the freezer compartment 112 by a mullion 113. In the present disclosure, a bottom freezer type refrigerator in which the refrigerator compartment 111 is disposed above the freezer compartment 112 will be exemplified.

Further, the door includes a refrigerator compartment door 12 for opening and closing the refrigerator compartment 111 and a freezer compartment door 13 for opening and closing the freezer compartment 112. Specifically, the refrigerator compartment door 12 may include a single pivotable door pivotally provided on the side edge of the front face of the cabinet 11, or French doors which are pivotally provided on the left and right edges of the front face of the cabinet 11 respectively and which open or close an opening in the front face of the refrigerator compartment 111. The former and latter door may be selected depending on the structure. In this embodiment, an example in which the refrigerator compartment door 12 is provided in the form of the French doors will be illustrated. In one embodiment, the freezer compartment door 13 may also be provided as a French type door as in the refrigerator compartment door 12, or alternatively as a drawer type door.

The pair of refrigerator compartment doors 12 are pivotally connected to the front face of the cabinet 11 via a hinge assembly. In addition, a plurality of storage casings 121 including a shelf or a basket may be arranged on the back face of the pair of the refrigerator compartment doors 12 in the vertical direction.

Inside the refrigerator compartment 111, a plurality of storage boxes 115 and a plurality of shelf assemblies 20 may be arranged. Specifically, the plurality of storage boxes 115 may be arranged side by side on the left and right sides of the refrigerator compartment 111. The plurality of storage boxes 115 may be arranged in the vertical direction as well. In addition, the plurality of shelf assemblies 20 may be disposed side by side on the left and right sides of the refrigerator compartment 111. Further, the plurality of shelf assemblies 20 may be arranged in the vertical direction as well.

The cabinet 11 may include an inner cabinet 117 defining the refrigerator compartment 111 and the freezer compartment 112, an outer cabinet 116 surrounding the inner cabinet 117 and forming the appearance of the cabinet 11, and a thermal insulating material (not shown) filled between the inner cabinet 117 and the outer cabinet 116.

Further, the shelf assembly 20 may include a shelf support arm 21 in the form of a cantilever secured to the rear face of the inner cabinet 117, and a shelf 22 that slides in an anteroposterior direction along the shelf support arm 21 in a state of being seated on the top face of the shelf support arm 21.

Accordingly, the user may open the refrigerator compartment door 12 on the left side to withdraw food stored in the storage box 115 and the shelf assembly 20 on the left side. The user may open the refrigerator compartment door 12 on the right side to withdraw food stored in the storage box 115 and the shelf assembly 20 on the right side.

The refrigerator according to the embodiment of the present disclosure may include a shelf withdrawing mechanism 30 that allows the shelf assembly 20 located on the back face of the refrigerator compartment door to move forward of the refrigerator compartment 111 when either the left or right refrigerator compartment door is opened.

Hereinafter, a shelf withdrawing mechanism for performing the above function will be specifically described with reference to the drawings.

Figure 3:
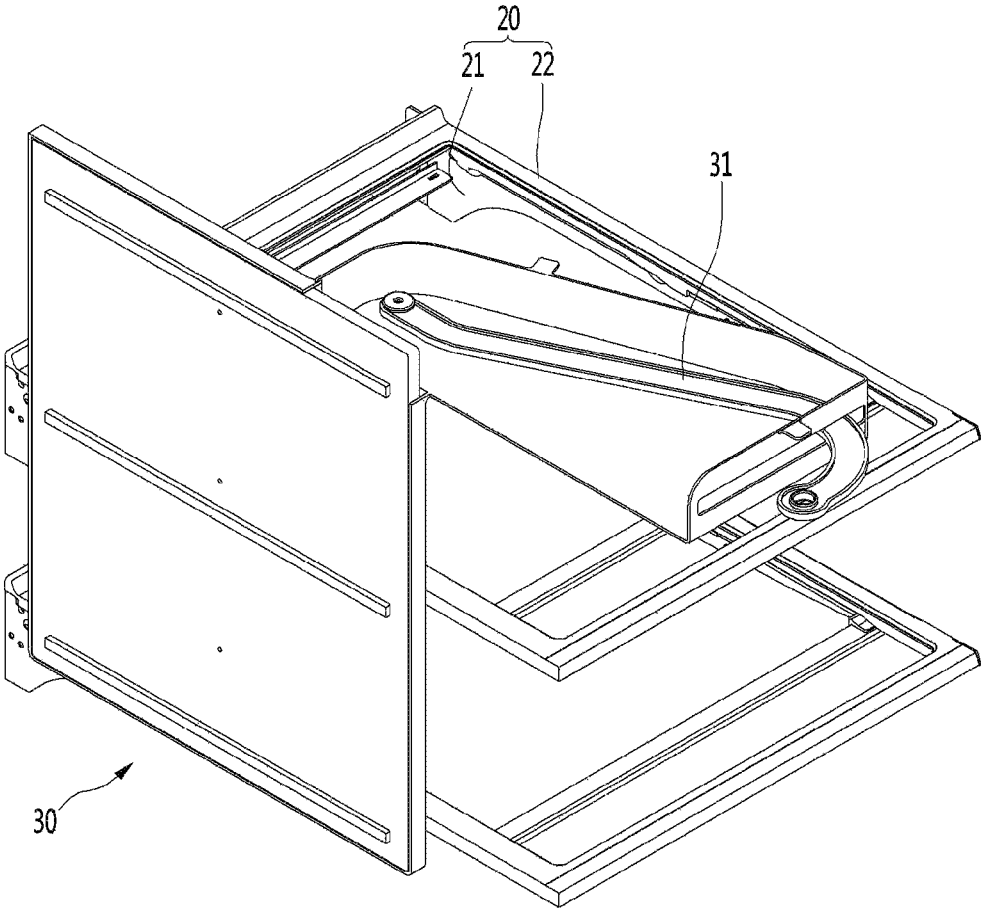
FIG. 3 is a perspective view of a shelf withdrawing mechanism according to an embodiment of the present disclosure.
Figure 4:
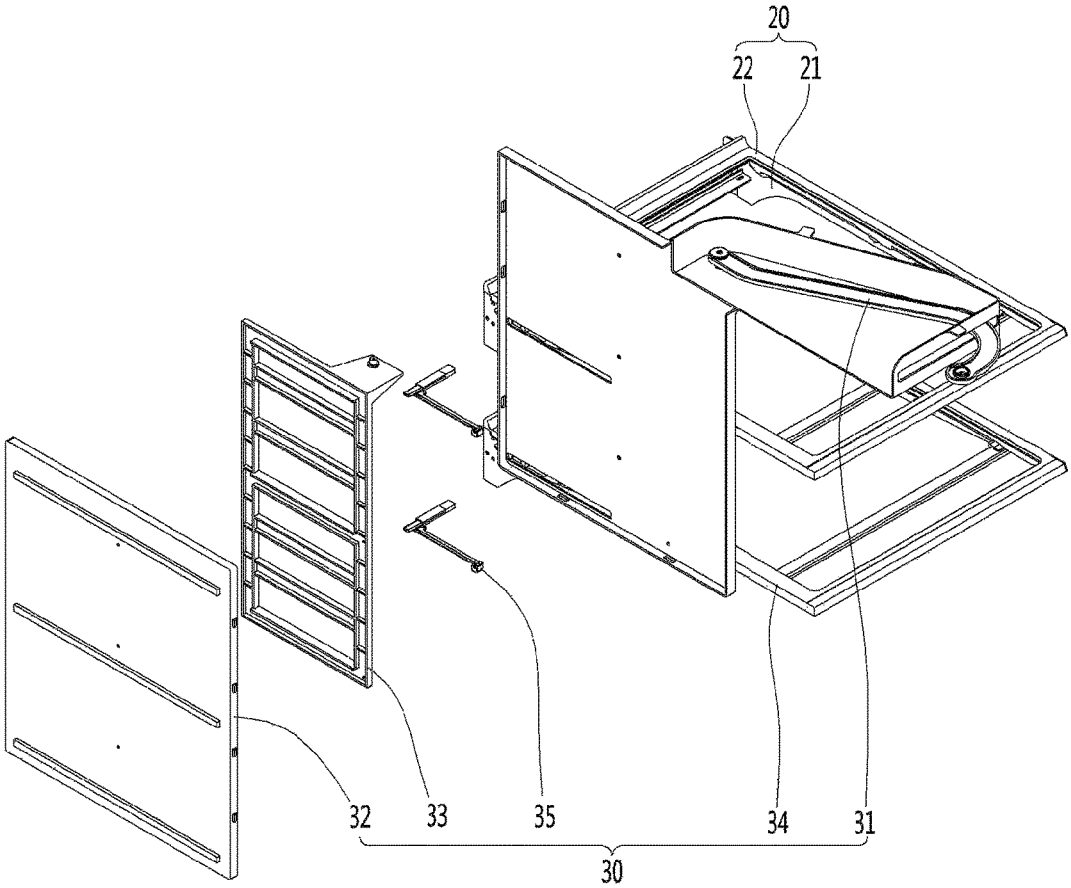
FIG. 4 is an exploded perspective view of the withdrawing mechanism.

FIG. 3 is a perspective view of the shelf withdrawing mechanism according to an embodiment of the present disclosure. FIG. 4 is an exploded perspective view of the withdrawing mechanism.

Referring to FIG. 3 and FIG. 4, the withdrawing mechanism 30 according to the embodiment of the present disclosure may allow the shelf 22 of the shelf assembly 20 to be withdrawn forward when the door 12 is opened. When the door 12 is closed, the withdrawing mechanism 30 functions to insert the shelf 22 into the refrigerator.

Specifically, the shelf assembly 20 is secured to a pair of support frames (not shown) mounted perpendicularly to the rear face of the refrigerator compartment 111. In one example, a catch hook protrudes from each of the left and right rear-end portion portions of the shelf support arm 21. Each catch hook is inserted into each of catch holes formed in the pair of support frames. In addition, the shelf 22 is coupled to the shelf support arm 21 to be slidable from the shelf support arm 21 in the anteroposterior direction.

Furthermore, the withdrawing mechanism 30 may include an inner casing 34 that forms a portion of the side face of the refrigerator compartment 111, i.e., a portion of the inner cabinet 117, an outer casing 32 coupled with the inner casing 34 on the opposite side of the inner casing 34, a sliding member 33 provided between the inner casing 34 and the outer casing 32 and movable in the anteroposterior direction of the refrigerator 10, a link member 31 connecting the top face of the sliding member 33 to the top face of the door 12, and a connector 35 that connects the sliding member 33 to the shelf 22. The connector 35 may be removably coupled to the side face of the shelf 22 and may selectively be coupled to the sliding member 33.

Specifically, when opening the door 12, the link member 31 is moved forward while rotating about the center of rotation of the door 12. As a result, the sliding member 33 connected to the rear end of the link member 31 moves forward of the refrigerator 10. Moreover, as the sliding member 33 moves forward, the shelf 22 connected to the sliding member 33 via the connector 25 is moved forward.

The outer casing 32 and the sliding member 33 may be placed in the space between the inner cabinet 117 and the outer cabinet 116. They may be surrounded by the heat insulating material to prevent shaking thereof. In addition, since the sliding member 33 is located outside the inner casing 34, the sliding member 33 is not exposed to the outside when the user opens the door 12 so that the refrigerator compartment 111 opens.

Hereinafter, each component constituting the withdrawing mechanism will be described in more detail with reference to the drawings.

Figure 5:
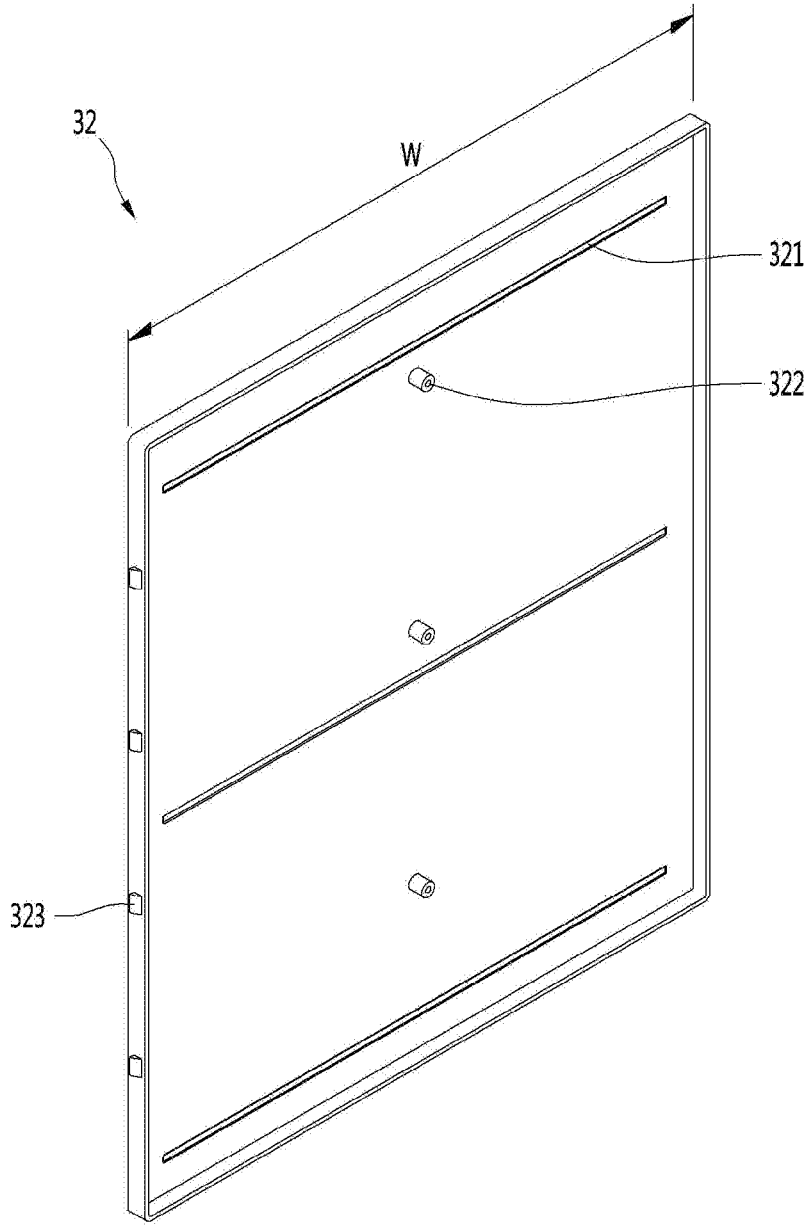
FIG. 5 is a perspective view of an outer casing that constitutes the withdrawing mechanism according to an embodiment of the present disclosure.

FIG. 5 is a perspective view of the outer casing constituting the withdrawing mechanism according to the embodiment of the present disclosure.

Referring to FIG. 5, the outer casing 32 constituting the withdrawing mechanism 30 according to the embodiment of the present disclosure has a rectangular plate shape having a predetermined width W. Four edges of the outer casing are vertically bent to define the thickness. In addition, a plurality of coupling portions 323 may be formed on the bent portion of the outer casing 32.

Further, a plurality of coupling bosses 322 may protrude from the center of the inner face of the outer casing 32 and may be spaced apart from each other by a predetermined distance in the longitudinal direction of the outer casing 32.

Further, a plurality of guide grooves 321 are formed in the outer casing 32. Each groove 321 may extend by a predetermined length in the width direction of the outer casing 32. In addition, the plurality of guide grooves 321 may be arranged at regular intervals in the longitudinal direction of the outer casing 32.

Figure 6:
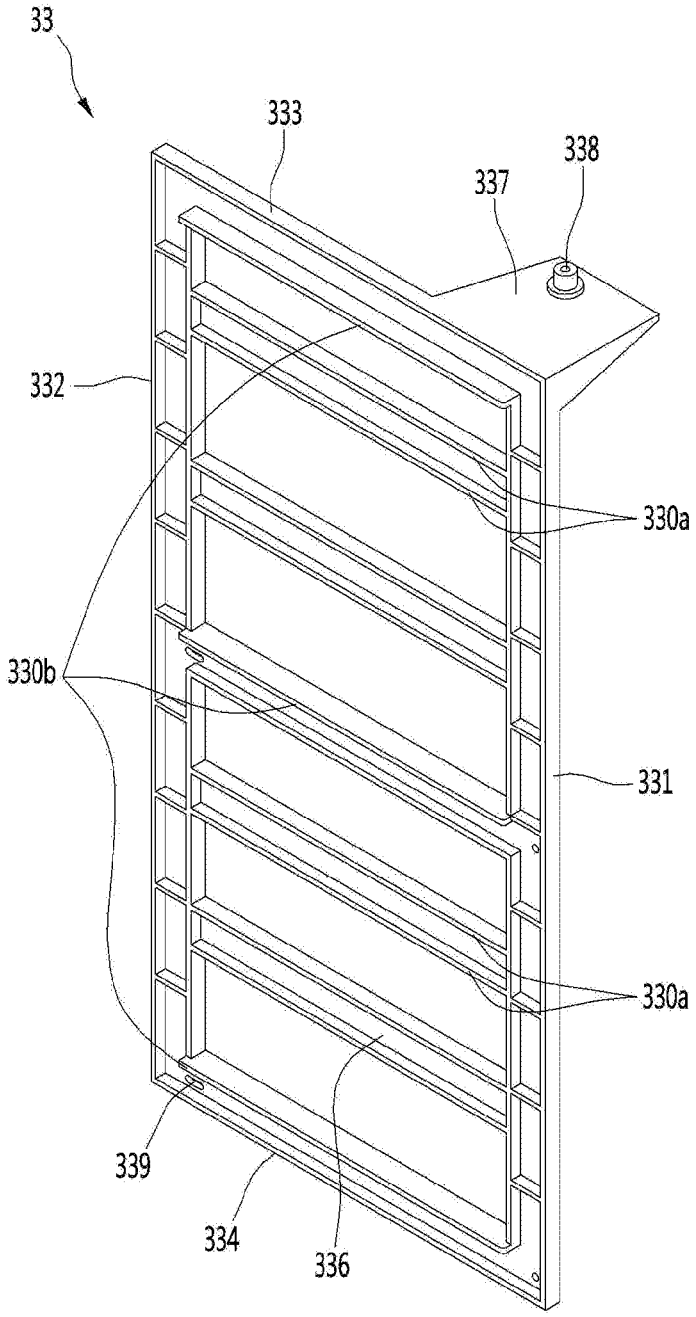
FIG. 6 is a perspective view of a sliding member constituting the withdrawing mechanism according to an embodiment of the present disclosure.

FIG. 6 is a perspective view of a sliding member constituting a withdrawing mechanism according to the embodiment of the present disclosure.

Referring to FIG. 6, the sliding member 33 constituting the withdrawing mechanism 30 according to the embodiment of the present disclosure may be formed in a substantially rectangular frame shape.

Specifically, the sliding member 33 may include an outer face 336 facing the outer casing 32, an inner face 335 (FIG. 8) facing the inner casing 34 as the opposite face to the outer face 336, a front-end portion 331 facing the front face of the refrigerator 10, a rear-end portion 332 defining a face opposite the front-end portion 331, an upper-end portion 333 connecting the top faces of the front-end portion 331 and the rear-end portion 332, a lower-end portion 334 connecting the bottom face of the front-end portion 331 and the bottom face of the rear-end portion 332, a link-connection portion 337 vertically protruding from the upper-end portion 333, and a link-connection boss 338 protruding from the top face of the link-connection portion 337.

Further, a plurality of guide ribs **330*b* may be protruded from the outer face 336 of the sliding member 33 to guide movement of the sliding member 33 in the anteroposterior direction. Further, a plurality of spacer ribs 330*a* may be protruded from the outer face 336 such that the outer casing 32 is spaced apart from the sliding member 33** by a predetermined distance.

The guide rib **330*b* protrudes at a position corresponding to the guide groove 321 formed in the outer casing 32, is inserted into the guide groove 321**, and moves in an anteroposterior direction.

The guide groove 321 may be formed to protrude from the inner face of the outer casing 32 to the outer face thereof. The vertical width or thickness of the guide groove 321 may have a size corresponding to the thickness of the guide rib **330*b*. As moving the guide rib 330*b* along and in the guide groove 321, this may prevent the sliding member 33 from shaking when the member 33** is moving.

Figure 7:
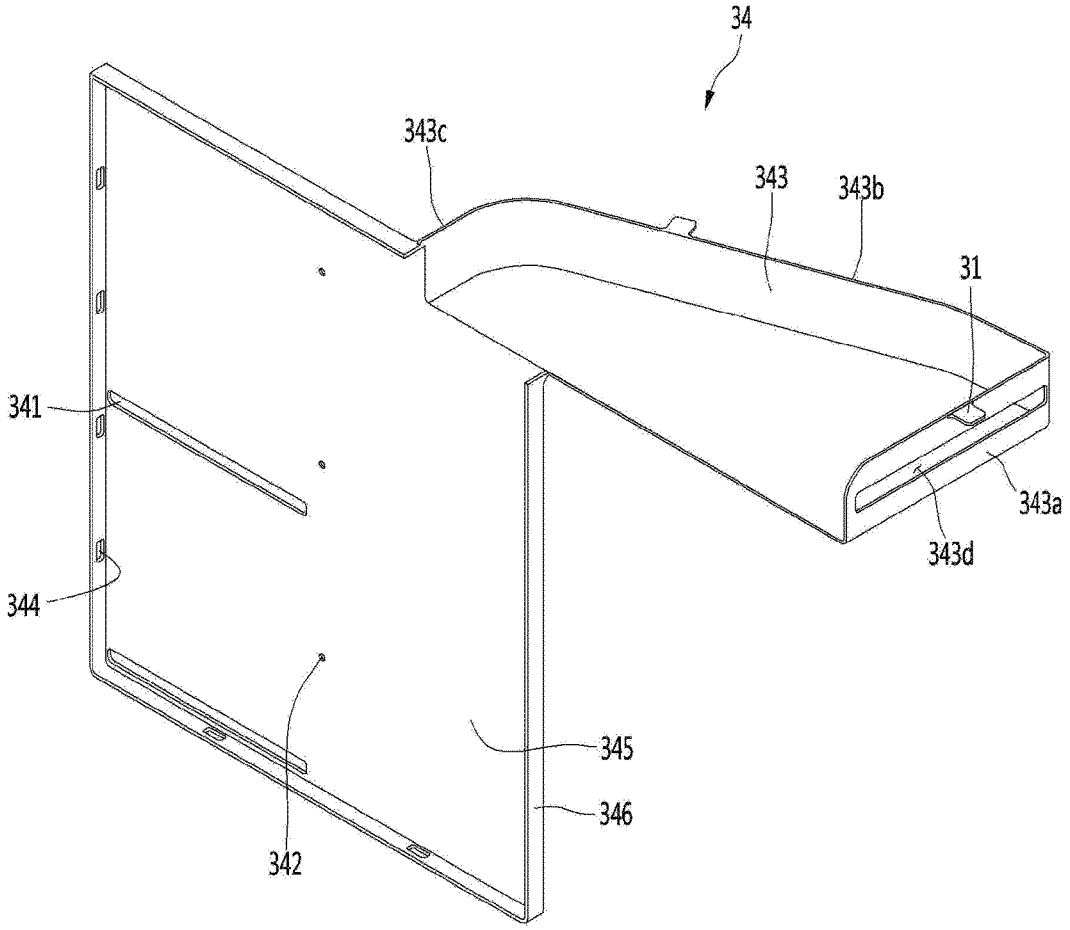
FIG. 7 is a perspective view of an inner casing constituting the withdrawing mechanism according to an embodiment of the present disclosure.

FIG. 7 is a perspective view of the inner casing constituting the withdrawing mechanism according to the embodiment of the present disclosure.

Referring to FIG. 7, the inner casing 34 constituting the withdrawing mechanism 30 according to the embodiment of the present disclosure may include a casing body 345 having a rectangular plate shape corresponding to the shape of the outer casing 34, and a link cover portion 343 extending vertically from the top of the casing body 345.

Specifically, the inner casing 34 may further include an edge portion 346 bent outwardly from the edge of the casing body 345. A plurality of coupling holes 344 may be formed in the edge portion 346. In addition, the coupling portions 323 formed on the edge portions of the outer casing 32 are inserted into the coupling holes 344 respectively such that the inner casing 34 and the outer casing 32 may be integrally coupled to each other.

Further, a plurality of coupling holes 342 may be formed in the center of the casing body 345. The plurality of coupling holes 342 may be arranged at regular intervals in the longitudinal direction of the casing body 345. In addition, the coupling bosses 322 protruding from the outer casing 32 are respectively fitted into the plurality of coupling holes 342. In addition, a coupling member passing through the coupling hole 342 may be inserted into the coupling boss 322 such that the inner casing 34 and the outer casing 32 may be coupled together. Moreover, the casing body 345 of the inner casing 34 and the outer casing 32 may be spaced apart from each other by the projecting length of the coupling boss 322 to define a space. The sliding member 33 may be received in the space.

Further, in the casing body 345, a number of guide slits 341 corresponding to the number of the shelves 22 are formed.

Specifically, the connector 35 may be inserted into the guide slit 341. The connector moves in and along the slit. The slit may be formed to position-correspond to the side face of the shelf assembly 20. Therefore, even when the shelf 22 moves in the anteroposterior direction, the guide slit 341 is not exposed to the outside due to the shelf support arm 21.

Furthermore, the link cover portion 343 is constructed to have a space defined therein for accommodating the link member 31. The link cover portion 343 performs a shielding function for shielding the link member so that the link member 31 is not exposed to the interior of the refrigerator when the user opens the door 12.

Specifically, the link cover portion 343 has a horizontal portion extending horizontally from the top of the casing body 345 and a vertical portion extending upward from the edge of the horizontal portion. In addition, the vertical portion has a front wall 343*a*, a side wall 343*b*, and a rear wall 343*c*. The ends of the walls constituting the vertical portion are in close contact with the top face of the inner cabinet 117, that is, the ceiling of the refrigerator compartment 111. In addition, in the front wall 343*a*, a link through-hole 343*d* through which the link member 31 passes may be formed. Therefore, a remaining portion of the link member 31 except for a portion of the member 31 protruding forward through the link through-hole 343*d* may be shielded by the link cover portion 343 and may not be exposed to the outside.

In this connection, the inner cabinet 117 may replace the casing body 345, and only the link cover portion 343 may be provided so as to connect the top and the ceiling portion of the inner cabinet 117. Thus, the guide slit 341 may be formed in the inner cabinet 117. Furthermore, the outer casing 32 may be coupled directly to the inner cabinet 117.

Figure 8:
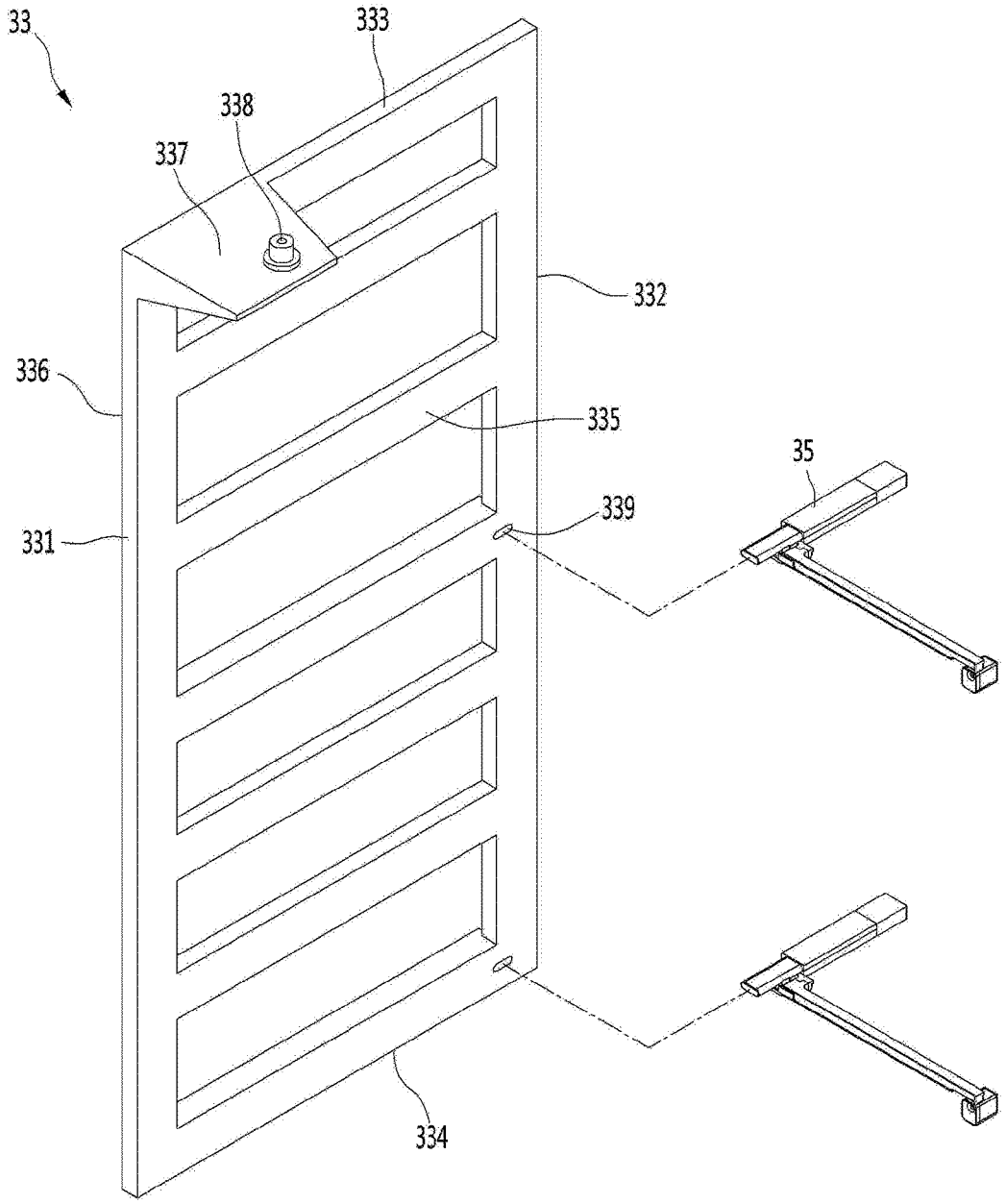
FIG. 8 shows a state in which a connector constituting the withdrawing mechanism is connected to the sliding member constituting the withdrawing mechanism according to an embodiment of the present disclosure.
Figure 9:
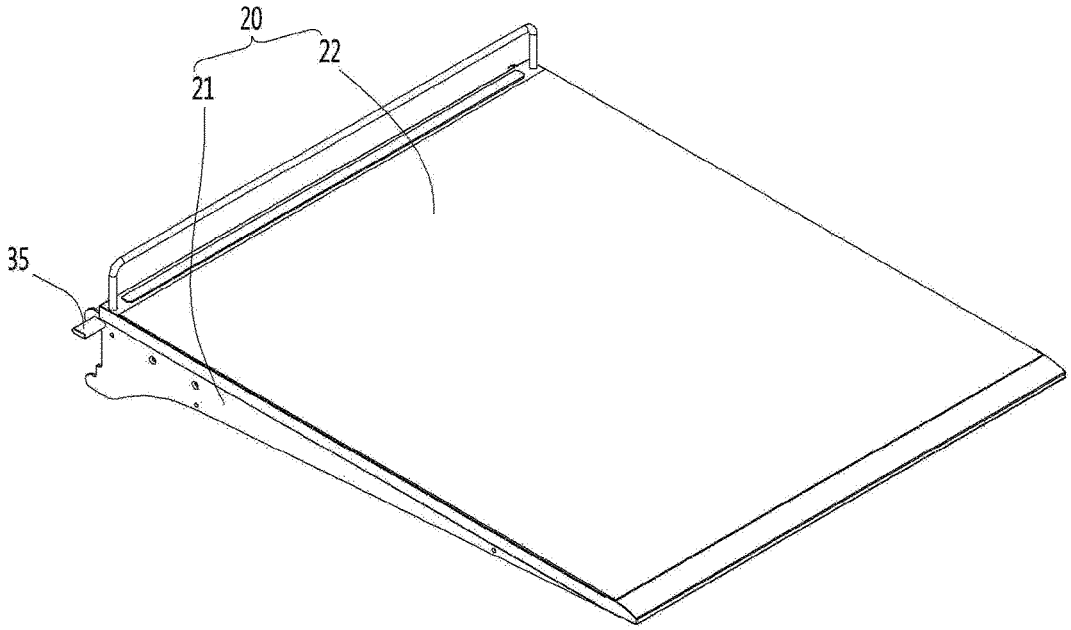
FIG. 9 is a perspective view of a shelf assembly having the connector mounted thereon.

FIG. 8 is a view showing a state where the connector constituting the withdrawing mechanism is connected to the sliding member according to an embodiment of the present disclosure. FIG. 9 is a perspective view of a state in which the connector is mounted on the shelf assembly.

Referring to FIG. 8 and FIG. 9, a receiving groove 339 is defined within the edge of the rear-end portion of the inner face 335 of the sliding member 33. In addition, a connector 35 that fits in the receiving groove 339 of the sliding member 33 is mounted on the shelf assembly 20.

Specifically, the connector 35 may be removably coupled to the edge of the bottom face of the shelf 22. The connector 35 may be connected to the shelf 22 and may be moved integrally with the shelf 22. In addition, a portion of the connector 35 may protrude outward from the rear end of the shelf support arm 21 and be exposed to the outside. Thus, substantially the protruding portion of the connector 35 is fitted into the receiving groove 339. In this connection, the protruding portion of the connector 35 may be referred to as a "protrusion".

Specifically, the protrusion of the connector 35 may be inserted into the receiving groove 339 of the sliding member 33 through the guide slit 341 of the inner casing 34. Thus, the connector 35 may be connected to the sliding member 33 and may be moved integrally with the sliding member 33.

Using this structure of the withdrawing mechanism 30, following may be achieved. When the user opens the door 12 of the refrigerator 10, the shelf 22 of the shelf assembly 20 is withdrawn forward. When the user closes the door 12, the shelf 22 is inserted into the refrigerator.

The connector 35 and receiving groove 339 may be formed at a point corresponding to the position of the shelf assembly 20. Each of numbers of the connectors 35 and receiving grooves 339 may correspond to the number of the shelf assemblies 20.

According to the present disclosure, inserting the protrusion of the connector 35 by a predetermined length inwardly of the shelf assembly 20 may allow the protrusion to be separated from the receiving groove 339 of the sliding member 33. In this case, since the length of the protrusion is relatively short, the protrusion does not reach the receiving groove 339 of the sliding member 33. Thus, when the protrusion is inserted by the predetermined length inwardly of the shelf 22, the shelf 22 is not withdrawn forward in a response wot the opening operation of the door 12. Thus, the position of the shelf 22 may be maintained on the top face of the shelf support arm 21.

According to the embodiment of the present disclosure, the user inserts the protrusion of the connector 35 into the inside of the shelf 22 by the predetermined length via pressing of a pressing portion on the connector 35. Thus, the association movement between the door 12 and the shelf 22 may be disabled.

Hereinafter, the pressing portion of the connector for performing the same function will be described in detail with reference to the drawings.

Figure 10:
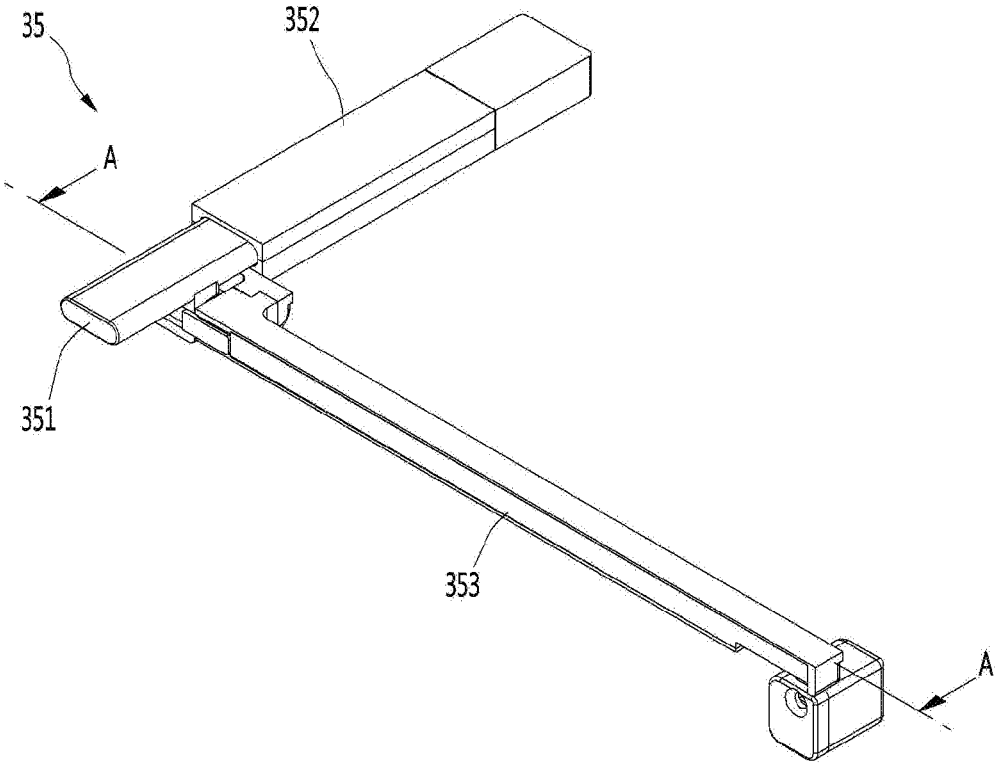
FIG. 10 is a perspective view of the connector according to an embodiment of the present disclosure.
Figure 11:
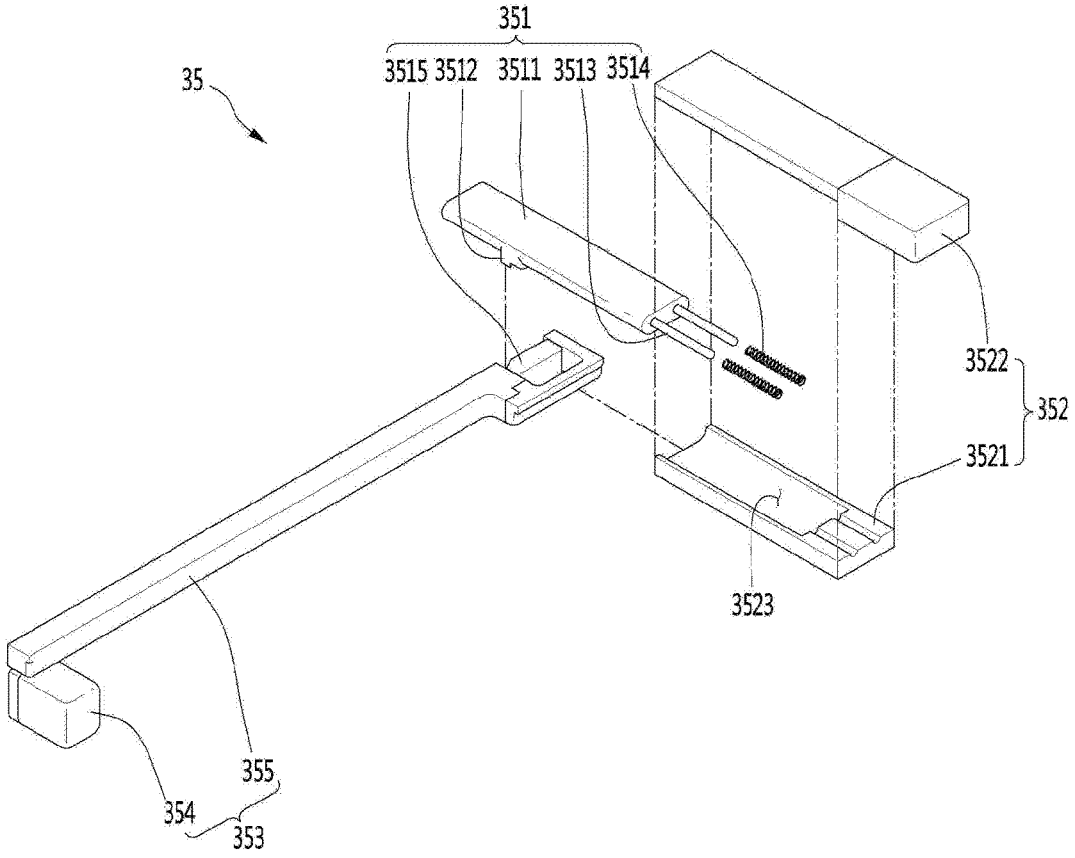
FIG. 11 is an exploded perspective view of the connector.
Figure 12:
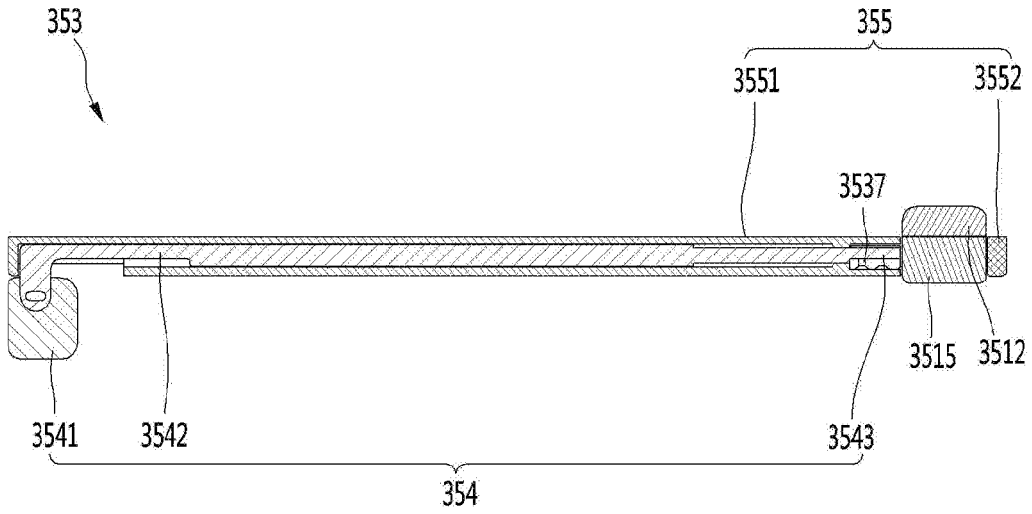
FIG. 12 is a vertical cross-sectional view as taken along a line A-A in FIG. 10.

FIG. 10 is a perspective view of the connector according to an embodiment of the present disclosure. FIG. 11 is an exploded perspective view of the connector. FIG. 12 is a vertical cross-sectional view taken along a line A-A of FIG. 10.

Referring to FIG. 10 to FIG. 12, the connector 35 according to an embodiment of the present disclosure may include a connecting unit 351 protruding out of the shelf assembly 20 for being selectively inserted in the receiving groove 339 of the sliding member 33, a guide unit 352 surrounding a part of the connecting unit 351 and guiding the connecting unit 351 so as to be movable in the lateral direction of the refrigerator 10, an actuating unit 353 for enabling inserting of the connecting unit 351 into the interior of the guide unit 352.

The connecting unit 351 may be a portion that protrudes toward the side of the shelf assembly 20 and is selectively inserted in the receiving groove 339. The connecting unit 351 may be accommodated in a receiving space 3523 defined in the guide unit 352 and may be configured to be movable in the lateral direction of the refrigerator 10.

Specifically, the connecting unit 351 may include a body portion 3511 received within the receiving space 3523 and having one end selectively inserted into the receiving groove 339, a coupling portion 3512 formed on the bottom face of the body portion 3511, a contact portion 3515 which is coupled to the coupling portion 3512 and has a first inclined face (3516 in FIG. 13) on one end thereof, an extending portion 3513 protruding from the side face of the body portion 3511, and an elastic member 3514 surrounding the extending portion 3513.

Specifically, the body portion 3511 has a rod shape extending long in the lateral direction of the refrigerator 10. The edge portion of the portion 3511 may be rounded. Further, when the contact portion 3515 is coupled to the coupling portion 3512 so that the unit 351 is mounted on the actuating unit 353. The body portion 3511 may, in part, be placed on the top face of the rear end of the he actuating unit 353 while the body portion 3511 may be partially received within the receiving space 3523 defined within the guide unit 352. In addition, the body portion 3511 may be moved laterally within the receiving space 3523.

The extending portion 3513 may be a portion wound by the elastic member 3514 so that the body portion 3511 moves laterally within the receiving space 325. The extending portion 3513 may protrude a predetermined length from the side face of the body portion 3511. The extending portion 3513 may be received in the receiving space 3523 defined within the guide unit 352.

The elastic member 3514 may be wound around the extending portion 3513 to elastically support the side surface of the body portion 3511. In one example, the elastic member 3514 may include a spring. One end of the elastic member 3514 contacts the side face of the body portion 3511, while the other end of the member 3514 may be fixed to the inner wall of the guide unit 352. Accordingly, when the body portion 3511 is moved to the right side of the refrigerator 10, the elastic member 3514 is compressed. At this time, the elastic member 3514 may provide a pressing force for pressing the body portion 3511 toward the left side of the refrigerator 10 using the restoring force thereof.

The coupling portion 3512 may be a portion coupled to the contact portion 3515. The coupling portion 3512 may be connected to the contact portion 3515 and may be moved integrally with the coupling portion 3512.

The contact portion 3515 may be coupled to the connecting unit 351 and inserted into the actuating unit 353.

Specifically, the contact portion 3515 may be coupled to the coupling portion 3512 and be accommodated in a predetermined space within the actuating unit 353. The first inclined face 3516 may be formed on one end of the contact portion 3515. The contact portion 3515 may be moved laterally within the predetermined space via relative movement with a second inclined face 3544 of the movable portion 354, which will be described later.

In this figure, the contact portion 3515 is illustrated as being separate from the body portion 3511. However, the present disclosure is not so limited. The contact portion 3515 may be integrally formed on the bottom face of the body portion 3511.

The guide unit 352 serves to guide the unit 351 so that the connecting unit 351 moves in a direction to be inserted into the receiving groove 339 or in a direction away from the groove. The guide unit 352 has the space in which the contact portion 3515 is accommodated.

Specifically, the guide unit 352 may include a lower housing 3521 on which the connecting unit 351 is seated, and an upper housing 3522 covering the top face of the lower housing 3521. The lower housing 3521 and the upper housing 3522 may be removably coupled to each other.

The receiving space 3523 may be defined by recessing the top face of the lower housing 3521 in a shape corresponding to the shape of the body portion 3511 and the extending portion 3513. Furthermore, the bottom face of the upper housing 3522 may be recessed to correspond to the recessed shape of the lower housing 3521.

In one embodiment, the actuating unit 353 includes a pressing portion 3541 that the user grasps to insert the connecting unit 351 into the interior of the guide unit 352.

Specifically, the actuating unit 353 includes a movable portion 354 that moves in an anteroposterior direction, and a guide portion 355 fixed to the shelf 22 and guiding the movement of the movable portion 354.

More specifically, the movable portion 354 may include a pressing portion 3541 that the user grasps by hand, an extending portion 3542 extending rearward from the pressing portion 3541, and a protruding portion 3543 formed from the rear end of the extending portion 3542 and having a second inclined face 3544 formed on one side thereof.

The extending portion 3542 may extend in an elongated manner in the anteroposterior direction of the refrigerator 10 and may be mounted in the interior space of the guide portion 355. Furthermore, to the front end of the extending portion 3542, a pressing portion 3541 pressed by the user is fixed, while, to the rear end of the portion 3542, a protruding portion 3543 formed to press the contact portion 3515 is fixed.

Thee movable portion 354 may be moved in the anteroposterior direction in the inner space of the guide portion 355 via the pressing of the pressing portion 3541. At this time, the second inclined face 3544 formed on the protruding portion 3543 pushes the first inclined face 3516 formed on the contact portion 3515. Thus, the contact portion 3515 may be moved in the left direction or the right direction.

The guide portion 355 includes a cover portion 3551 that surrounds the extending portion 3542 and guides the anteroposterior directional movement of the extending portion 3542, and a space defining portion 3552 formed on the rear end of the cover portion 3551 and having a receiving space for receiving the contact portion 3515 therein.

The cover portion 3551 has a hollow shape. The cover portion 3551 may be formed to have a length corresponding to the length of the extending portion 3542 so as to accommodate the extending portion 3542. The inner space of the cover portion 3551 may be configured such that the extending portion 3542 is moved in an anteroposterior direction therein. Further, inside of the cover portion 3551, an elastic member 3537 for resiliently supporting the end portion of the extending portion 3542 when the extending portion 3542 moves in the anteroposterior direction may be further provided.

The space defining portion 3552 may be coupled to the end portion of the cover portion 3551. The accommodating space may be defined in the space defining portion 3552 so that the contact portion 3515 is movable a predetermined distance in the lateral direction of the refrigerator 10 in the space. The space defining portion 3552 may be formed in a substantially inverted L shape. the top face of the space defining portion 3552 may be located on the same line as the top face of the cover portion 3551. In addition, the guide unit 352 may be disposed on one side of the space defining portion 3552. In one example, the lower housing 3521 of the guide unit 352 may be fixedly attached to one side of the space defining portion 3552. Alternatively, the lower housing 3521 and the space defining portion 3552 may be integrally formed.

Hereinafter, the operation of separating the connecting unit from the receiving groove by pressing the pressing portion such that the contact portion moves in a predetermined direction will be described in detail with reference to the drawings.

Figure 13:
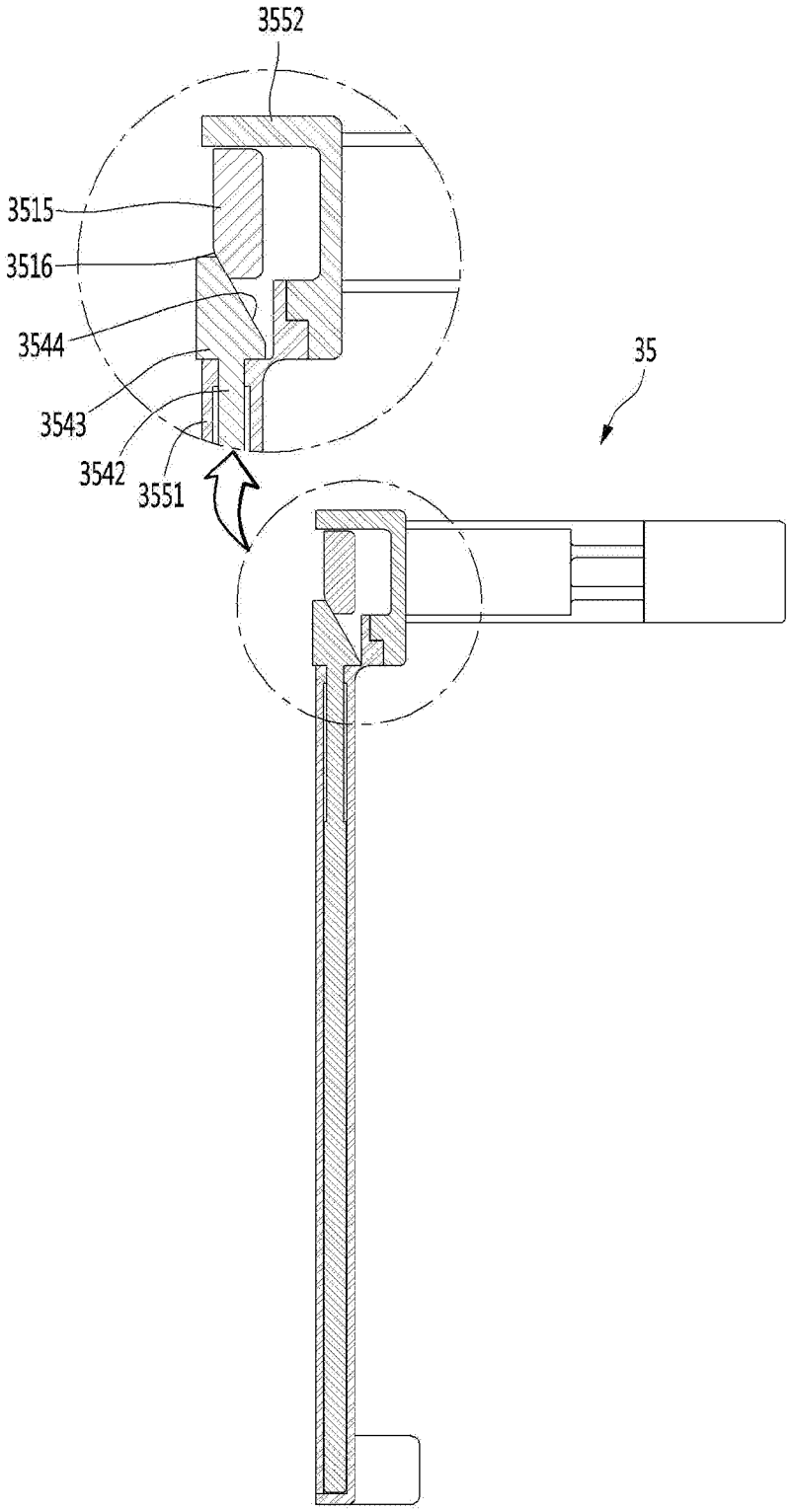
FIG. 13 shows a horizontal cross-sectional view of the connector according to an embodiment of the present disclosure.
Figure 14:
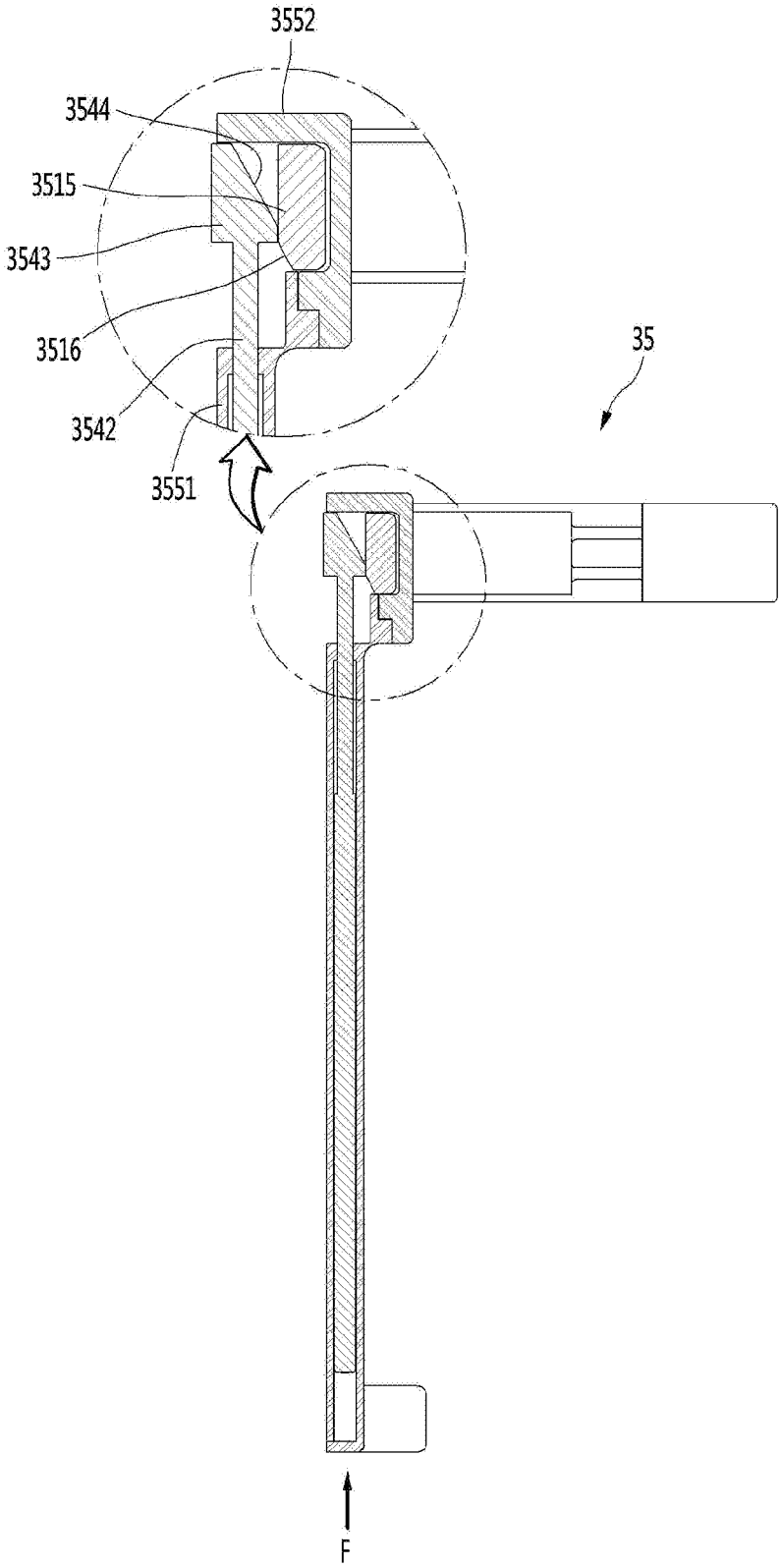
FIG. 14 shows a horizontal cross-sectional view of the connector with a movable portion thereof being pressed by the user, according to an embodiment of the present disclosure.

FIG. 13 is a horizontal cross-sectional view of the connector according to the embodiment of the present disclosure. FIG. 14 is a horizontal cross-sectional view of the connector when the movable portion is pressed by the user, according to the embodiment of the present disclosure.

First, referring to FIG. 13, the contact portion 3515 of the connector 35 may be urged in the left direction of the refrigerator 10 by the elastic member 3514.

Specifically, the contact portion 3515 may be urged in the left direction by the elastic member 3514 elastically supporting the side face of the body portion 3511 connected to the contact portion 3515. The contact portion 3515 may be laterally moved within the receiving space defined by the space defining portion 3552. At this time, the first inclined face 3516 of the contact portion 3515 may be in face-contact with the second inclined face 3544 of the protruding portion 3543.

That is, when the contact portion 3515 is urged in the left direction by the elastic member 3514, the first inclined face 3516 of the contact portion 3515 presses the second inclined face 3544 of the protruding portion 3543. In this way, the movable portion 354 can be moved toward the front face of the refrigerator 10.

When, as described above, the contact portion 3515 is moved in the left direction by the elastic member 3514, the body portion 3511 connected to the contact portion 3515 is inserted into the receiving groove 339 of the sliding member 33. Thus, when the refrigerator door 12 is opened, the shelf 22 may be withdrawn forward together with the sliding member 33.

Referring to FIG. 14, when the movable portion 354 is moved rearward of the refrigerator 10 by the pressing of the pressing portion 3541, the contact portion 3515 may be moved in the right direction in accordance with the backward movement of the movable portion 354.

Specifically, when the movable portion 354 is moved backward, and, thus, as the first inclined face 3516 of the contact portion 3515 moves relative to the second inclined face 3544 of the protruding portion 3543, the contact portion 3515 may be moved in the right direction. Subsequently, when the protruding portion 3543 is moved to the rear end of the space defining portion 3552, the connecting unit 351 connected to the contact portion 3515 is separated from the receiving groove 339 of the sliding member 33. Therefore, even when the refrigerator door 12 is opened, the shelf 22 is not connected to the sliding member 33. Thus, the shelf 22 is not withdrawn forward together with the sliding member 33.

At this time, the respective inclined contact faces 3516 and 3544 of the contact portion 3515 and the protruding portion 3543 are not in surface contact with each other. Rather, the parallel contact surfaces of the contact portion 3515 and the protruding portion 3543 are in surface contact with each other. Thus, even when the contact portion 3515 is pressed in the left direction by the elastic member 3514, the contact portion 3515 is no longer moved in the leftward direction. That is, when the movable portion 354 is moved to the end of the space defining portion 3552, the position of the contact portion 3515 may be held in a fixed manner.

Hereinafter, an operation of the connector will be described in detail with reference to the drawings.

Figure 15:
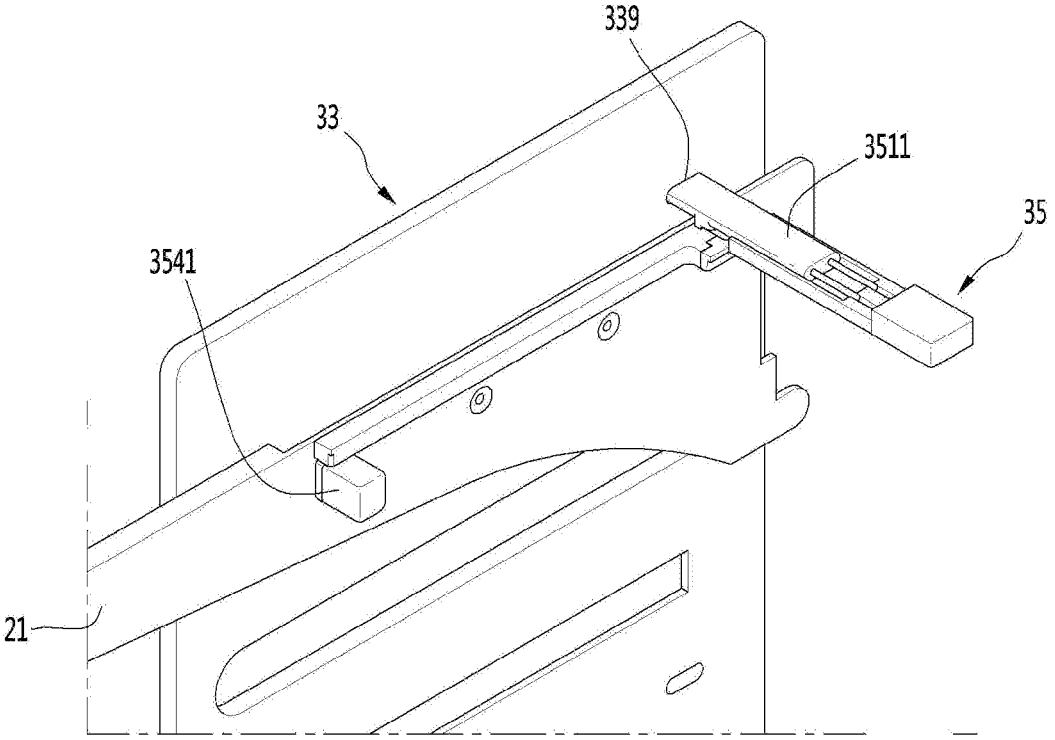
FIG. 15 shows the connector in a state which the shelf automatic withdrawing function is activated according to an embodiment of the present disclosure.
Figure 16:
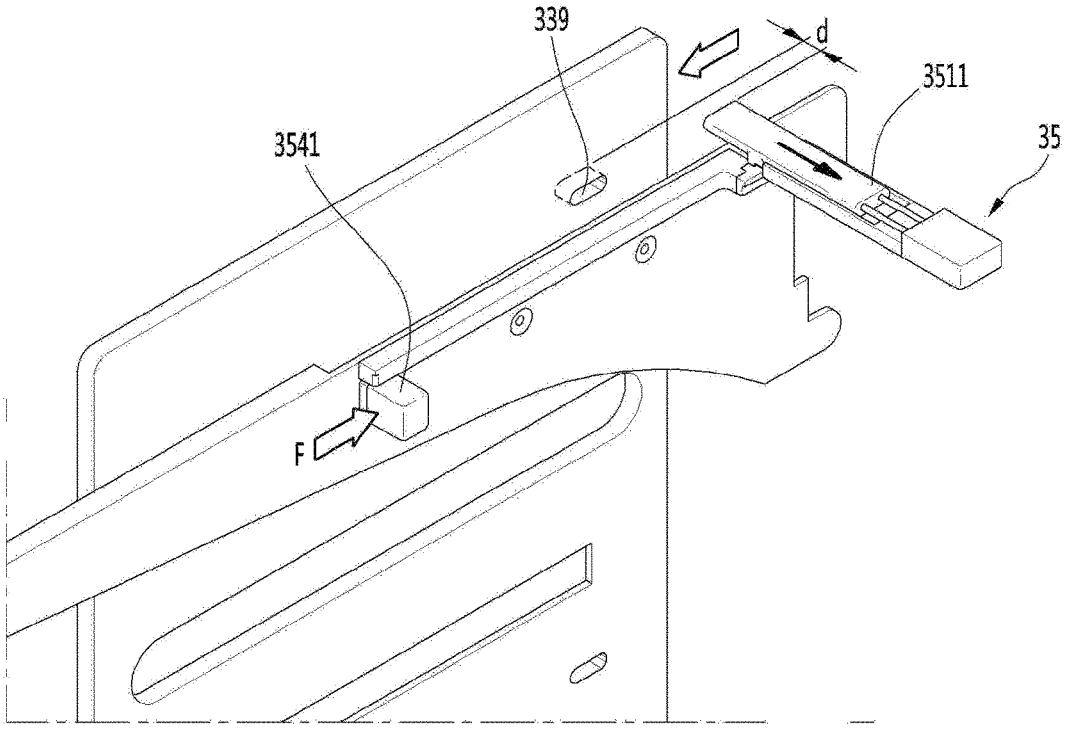
FIG. 16 shows the connector when the shelf automatic withdrawing function is disabled.

FIG. 15 shows a connector when the shelf automatic withdrawing function is activated according to the embodiment of the present disclosure. FIG. 16 shows the connector when the shelf automatic withdrawing function is deactivated.

First, referring to FIG. 15, the body portion 3511 of the connecting unit 351 is moved in the left direction by the elastic member 3514. Then, the unit 351 is inserted into the receiving groove 339 of the sliding member 33. Thus, coupling between the connecting unit 351 and the sliding member 33 may allow the shelf 22 to be withdrawn forward as the refrigerator door 12 is opened.

In contrast, referring to FIG. 16, when the user wishes to disable the shelf automatic withdrawing function, the user presses the pressing portion 3541. Then, the movable portion 354 is moved rearward. Thus, the first inclined face 3516 of the contact portion 3515 slides along the second inclined face 3544 of the movable portion 354. The portion 3515 is moved by a predetermined distance d in the right-ward direction. In addition, as the contact portion 3515 is moved in the right direction, the connecting unit 351 is separated from the receiving groove 339 of the sliding member 33.

Once the connection between the connecting unit 351 and the sliding member 33 is released, the shelf 22 is not withdrawn together with the sliding member 33 even when the sliding member 33 is withdrawn forward when the refrigerator door 12 is opened.

Figure 17:
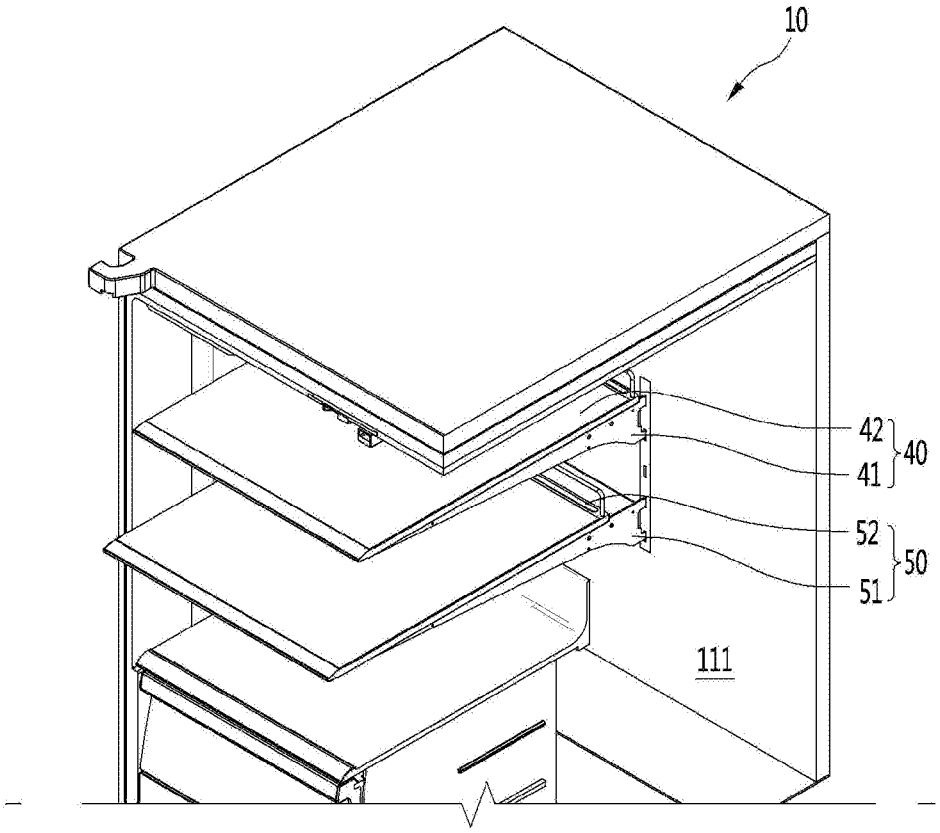
FIG. 17 shows the shelf when the shelf automatic withdrawing function is deactivated according to the embodiment of the present disclosure.

FIG. 17 shows a shelf when a shelf automatic withdrawing function is disabled according to the embodiment of the present disclosure.

Referring to FIG. 17, a plurality of shelf assemblies 40 and 50 may be arranged on the refrigerator compartment 111 in a vertical direction. The plurality of shelf assemblies 40 and 50 include a first shelf assembly 40 mounted on the rear side of the refrigerator compartment 111 and a second shelf assembly 50 disposed below the first shelf assembly 40.

The first shelf assembly 40 and the second shelf assembly 50 may respectively include a first shelf support arm 41 and a second shelf support arm 51 that are secured to the rear wall of the refrigerator compartment 111, and a first shelf 42 and a second shelf 52, which are installed so as to be movable in the anteroposterior direction on the shelf support arms, respectively.

According to the embodiment of the present disclosure, the user may also disable the shelf automatic withdrawing function for the desired shelf assembly among the shelf assemblies 40 and 50.

In one example, the user may disable the shelf automatic withdrawing function for the first shelf assembly 40 via manipulation of the connector. In this case, when the refrigerator door 12 is opened, the second shelf 52 of the second shelf assembly 50 is withdrawn forward as the refrigerator door 12 is opened. However, the first shelf 41 of the first shelf assembly 40 is not withdrawn forward as the refrigerator door 12 is opened.

According to this structure, the coupling between the shelf and the withdrawing mechanism for withdrawing the shelf may be released by a simple operation using the pressing portion of the connector. Thus, there is an advantage that the user can freely select whether to use the automatic withdrawing function for the opening of the refrigerator door.

What is claimed is:

1. A refrigerator comprising:

a cabinet that defines a storage space;

a door configured to open and close at least a portion of the storage space;

a shelf assembly comprising a shelf support arm fixed to an inside of the cabinet, and a shelf that is slidably connected to the shelf support arm; and a withdrawing mechanism configured to allow the shelf to be withdrawn forward based on the door being opened, the withdrawing mechanism comprising:

a sliding member that is disposed at a side surface of the cabinet, that is configured to move in a front-rear direction of the cabinet, and that defines a receiving groove, a link that connects the door to the sliding member and that is configured to causes the sliding member to move in the front-rear direction based on movement of the door, the link having a front end connected to the door and a rear end connected to the sliding member, and a connector that connects the sliding member to the shelf, the connector comprising:

a connecting unit that is configured to selectively insert into the receiving groove and that is configured to move in a lateral direction of the cabinet, a guide that defines a receiving space configured to receive the connecting unit and that is configured to guide the connecting unit to move into or away from the receiving groove, and an actuating unit that is configured to insert the connecting unit into the receiving space of the guide and that is configured to move in the front-rear direction.

2. The refrigerator of claim 1, wherein the connecting unit includes a first inclined surface, and wherein the actuating unit includes a second inclined surface configured to contact the first inclined surface.

3. The refrigerator of claim 2, wherein the connecting unit comprises:

a body portion having a first end configured to insert into the receiving groove;

a contact portion that is disposed at a bottom surface of the body portion and that defines the first inclined surface; and an elastic member configured to apply force to the body portion toward the receiving groove, the elastic member having a first end that is in contact with a second end of the body portion and a second end that is fixed to an inner side of the guide defining the receiving space.

4. The refrigerator of claim 3, wherein the actuating unit comprises:

a movable portion configured to move in the front-rear direction; and a guide portion fixed to the shelf and configured to guide movement of the movable portion.

5. The refrigerator of claim 4, wherein the movable portion comprises:

a pressing portion configured to be gripped by a user;

an extending portion that extends rearward from the pressing portion; and a protruding portion that is disposed at a rear end of the extending portion and that defines the second inclined surface.

6. The refrigerator of claim 5, wherein the guide portion comprises a cover portion that surrounds the extending portion and that is configured to guide movement of the extending portion in the front-rear direction, and wherein the guide portion defines a rear receiving space at a rear end of the cover portion, the rear receiving space receiving the contact portion.

7. The refrigerator of claim 6, wherein the protruding portion is configured to, based on the movable portion moving in the front-rear direction, move along the first inclined surface in a state in which the contact portion moves laterally in the rear receiving space.

8. The refrigerator of claim 6, wherein the body portion is configured to, based on the movable portion moving rearward, move in a direction that compresses the elastic member and separate from the receiving groove in a state in which the protruding portion moves relative to the contact portion.

9. The refrigerator of claim 8, wherein the elastic member is configured to, based on the movable portion moving forward, apply force to the body portion toward the receiving groove.

10. The refrigerator of claim 3, wherein the connecting unit further comprises an extending part that protrudes from a side surface of the body portion and that is surrounded by the elastic member.

11. The refrigerator of claim 2, wherein the guide comprises:

a lower housing that seats the connecting unit; and an upper housing that covers the lower housing and the connecting unit, and wherein the receiving space is defined between the lower housing and the upper housing.

12. The refrigerator of claim 2, wherein the connecting unit is configured to, based on the actuating unit moving toward a rear surface of the cabinet, move away from the receiving groove in a state in which the second inclined surface moves along the first inclined surface.

13. The refrigerator of claim 1, wherein the cabinet comprises an outer cabinet and an inner cabinet that is positioned inside of the outer cabinet and that defines the storage space, and wherein the shelf support arm is fixed to a rear surface of the inner cabinet.

14. The refrigerator of claim 13, wherein the inner cabinet defines a guide slit at a position corresponding to a position of the shelf, the guide slit having a predetermined length in a longitudinal direction of the shelf, and wherein the connecting unit is configured to pass through the guide slit to insert into the receiving groove.

15. The refrigerator of claim 14, wherein the predetermined length of the guide slit is less than a length of the shelf in the longitudinal direction.

16. The refrigerator of claim 1, wherein the link is spaced apart from the shelf and disposed vertically above the shelf.

17. The refrigerator of claim 1, wherein the withdrawing mechanism further comprises:

an outer casing disposed at the inside of the cabinet;

an inner casing that is spaced apart from the outer casing in the lateral direction and that faces a side of the shelf, and wherein the sliding member is disposed between the outer casing and the inner casing.

18. The refrigerator of claim 17, wherein the inner casing defines a guide slit at a position corresponding to a position of the shelf, the guide slit extending in the front-rear direction, and wherein the connecting unit is configured to pass through the guide slit to insert into the receiving groove.

19. The refrigerator of claim 17, wherein the inner casing comprises a link cover portion that extends from an upper side of the inner casing and that is disposed vertically above the shelf, and wherein the front end of the link protrudes through the link cover portion to connect to the door.

* * * * *